US008979562B2

(12) United States Patent
Crighton et al.

(10) Patent No.: US 8,979,562 B2
(45) Date of Patent: Mar. 17, 2015

(54) BUS BAR LOCKINGLY ATTACHED TO A HOUSING OF AN ELECTRICAL CONNECTOR AND ITS END INSERTED BETWEEN ROWS OF POWER CONTACTS OF THE ELECTRICAL CONNECTOR

(71) Applicants: Alan Crighton, Apex, NC (US); Christopher Geiski, Dillsburg, PA (US); Hung Viet Ngo, Austin, TX (US)

(72) Inventors: Alan Crighton, Apex, NC (US); Christopher Geiski, Dillsburg, PA (US); Hung Viet Ngo, Austin, TX (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 13/933,629

(22) Filed: Jul. 2, 2013

(65) Prior Publication Data

US 2014/0030899 A1 Jan. 30, 2014

Related U.S. Application Data

(60) Provisional application No. 61/675,581, filed on Jul. 25, 2012.

(51) Int. Cl.

| | |
|---|---|
| ***H01R 13/62*** | (2006.01) |
| ***H01R 12/00*** | (2006.01) |
| ***H01R 24/20*** | (2011.01) |
| ***H01R 13/627*** | (2006.01) |
| ***H01R 12/70*** | (2011.01) |
| *H01R 31/06* | (2006.01) |

(52) U.S. Cl.

CPC ..... *H01R 24/20* (2013.01); *H01R 13/627* (2013.01); *H01R 12/7088* (2013.01); *H01R 13/6272* (2013.01); *H01R 31/06* (2013.01)

USPC ..... 439/160; 438/66

(58) Field of Classification Search

USPC ..... 439/877–882

See application file for complete search history.

(56) References Cited

U.S. PATENT DOCUMENTS

| | | | | |
|---|---|---|---|---|
| 3,985,416 | A | | 10/1976 | Dola et al. |
| 5,240,420 | A | * | 8/1993 | Roberts ..... 439/62 |
| 5,306,160 | A | * | 4/1994 | Roberts ..... 439/62 |
| 5,470,245 | A | | 11/1995 | Ichimura |
| 5,813,883 | A | | 9/1998 | Lin |
| 6,685,501 | B1 | | 2/2004 | Wu et al. |

(Continued)

FOREIGN PATENT DOCUMENTS

JP 2002/186145 6/2006

OTHER PUBLICATIONS

International Patent Application No. PCT/US2013/050970: International Search Report dated Oct. 28, 2013, 10 pages.

*Primary Examiner* — Chandrika Prasad

(74) *Attorney, Agent, or Firm* — Baker & Hostetler LLP

(57) ABSTRACT

A connector assembly that includes an electrical connector and an electrically conductive busbar. The connector can include a housing that defines a receptacle, a first row of at least one power contact, and a second row of at least one power contact at a location spaced from the first row along a first direction. Each power contact of the first and second rows can define at least two mating ends that are at least partially disposed in the receptacle so as to define a slot that extends between the mating ends of the first row and the mating ends of the second row. The housing can include a first attachment member. The electrically conductive busbar can include a first end, a second end opposite the first end, and an attachment member that is configured to mate with the first attachment member so as to attach the busbar to the housing.

26 Claims, 12 Drawing Sheets

(56) References Cited

U.S. PATENT DOCUMENTS

| | | | | |
|---|---|---|---|---|
| 6,695,622 | B2 * | 2/2004 | Korsunsky et al. | 439/65 |
| 7,264,512 | B2 | 9/2007 | Wolford et al. | |
| 7,338,291 | B2 * | 3/2008 | Takada | 439/65 |
| 7,445,467 | B1 * | 11/2008 | Matsuo | 439/74 |
| 7,740,488 | B2 | 6/2010 | Taylor | |
| 7,938,658 | B1 * | 5/2011 | Zeng et al. | 439/160 |
| 8,360,789 | B2 * | 1/2013 | Yin et al. | 439/66 |
| 8,460,009 | B1 * | 6/2013 | Topolewski et al. | 439/65 |
| 2003/0137811 | A1 * | 7/2003 | Ling et al. | 361/759 |
| 2003/0148646 | A1 | 8/2003 | Frantum, Jr. et al. | |
| 2007/0173107 | A1 | 7/2007 | Wei et al. | |
| 2008/0220630 | A1 * | 9/2008 | Sipe et al. | 439/74 |
| 2008/0242161 | A1 * | 10/2008 | Takada et al. | 439/884 |
| 2010/0062648 | A1 * | 3/2010 | Guan et al. | 439/630 |
| 2010/0071953 | A1 | 3/2010 | Ichio et al. | |
| 2013/0040482 | A1 | 2/2013 | Ngo et al. | |

* cited by examiner

BUS BAR LOCKINGLY ATTACHED TO A HOUSING OF AN ELECTRICAL CONNECTOR AND ITS END INSERTED BETWEEN ROWS OF POWER CONTACTS OF THE ELECTRICAL CONNECTOR

CROSS REFERENCE TO RELATED APPLICATIONS

This application claim priority to U.S. Provisional Application No. 61/675,581 filed Jul. 25, 2012, the contents of which are hereby incorporated by reference in their entirety herein.

BACKGROUND

Connectors used to transmit electrical power, such as alternating current (AC) power and/or direct current (DC) power include power contacts mounted within an electrically-insulated housing. In a typical application, a receptacle connector includes two rows of power contacts that are configured to mate with a single row of power contacts of a corresponding header connector. In certain applications, however, it may be desired to electrically couple a first receptacle connector to a second receptacle connector.

SUMMARY

In one embodiment, an electrical connector assembly can include an electrical connector and a busbar. The electrical connector can include an electrically insulative connector housing that defines a receptacle. The electrical connector can further include a first row of at least one power contact supported by the housing, and a second row of at least one power contact supported by the housing at a location spaced from the first row. Each power contact of the first and second rows can define at least two mating ends that are at least partially disposed in the receptacle so as to define a slot that extends between the mating ends of the first row and the mating ends of the second row. The connector housing can include a latch. The busbar can include an electrically conductive busbar contact having a first end and a second end opposite the first end. The busbar can define a recess that is configured to receive the latch so as to lockingly attach the busbar to the connector housing when the first end of the busbar contact is received by the receptacle in a mating direction such that 1) the first end of the busbar contact is brought into physical and electrical contact with the at least two mating ends of each of the first and second rows within the slot, and 2) the second end of the busbar contact is spaced from the receptacle in a withdrawal direction that is opposite the mating direction.

In another embodiment, an electrical connector assembly can include a first electrical connector, a second electrical connector, and a busbar. The first electrical connector can include an electrically insulative first connector housing that defines a first receptacle. The first electrical connector can further include a first row of at least one power contact supported by the first connector housing, and a second row of at least one power contact supported by the first connector housing at a location spaced from the first row along a first direction. Each power contact of the first and second rows can define at least two mating ends that are at least partially disposed in the receptacle so as to define a slot that extends along the first direction between the mating ends of the first row and the mating ends of the second row.

The second electrical connector can include a electrically insulative second connector housing that defines a receptacle.

The second electrical connector can further include a first row of at least one power contact supported by the second housing, and a second row of at least one power contact supported by the second housing at a location spaced from the first row along the first direction. Each power contact of the first and second rows of the second electrical connector can define at least two mating ends that are at least partially disposed in the receptacle so as to define a slot that extends along the first direction between the mating ends of the first row of the second electrical connector and the mating ends of the second row of the second electrical connector.

The busbar can include an electrically conductive busbar contact that defines a first end and a second end that is spaced from the first end. The busbar can include an attachment member that is configured to mate with the first attachment member to thereby lockingly attach the busbar to the first electrical connector when the busbar is fully received in the slot of the first electrical connector. When the first end of the busbar contact is fully received in the slot of the first electrical connector and the second end of the busbar contact is fully received into the slot of the second electrical connector, the busbar lockingly attaches to the first electrical connector such that as the first and second electrical connectors are separated from each other, the busbar remains attached to the first electrical connector and the second end withdraws from the slot of the second electrical connector.

A method of electrically connecting a first receptacle electrical connector to a second receptacle electrical connector is also disclosed. The method can include the steps of inserting a first end of a busbar into a slot defined between first and second rows of electrically conductive mating ends of a first electrical receptacle connector such that the busbar lockingly attaches to the first electrical receptacle connector; inserting a second end of the busbar into a slot defined between first and second rows of electrically conductive mating ends of a second electrical receptacle connector; and separating the first and second electrical receptacle connectors from each other; such that during the separating step, the busbar remains attached to the first electrical receptacle connector and the second end withdraws from the second electrical connector.

BRIEF DESCRIPTION OF THE DRAWINGS

The foregoing summary, as well as the following detailed description of the preferred embodiments of the application, will be better understood when read in conjunction with the appended drawings. For the purposes of illustration, there are shown in the drawings preferred embodiments. It should be understood, however, that the instant application is not limited to the precise arrangements and/or systems illustrated in the drawings, in which.

DETAILED DESCRIPTION OF ILLUSTRATIVE EMBODIMENTS

Figure 1:
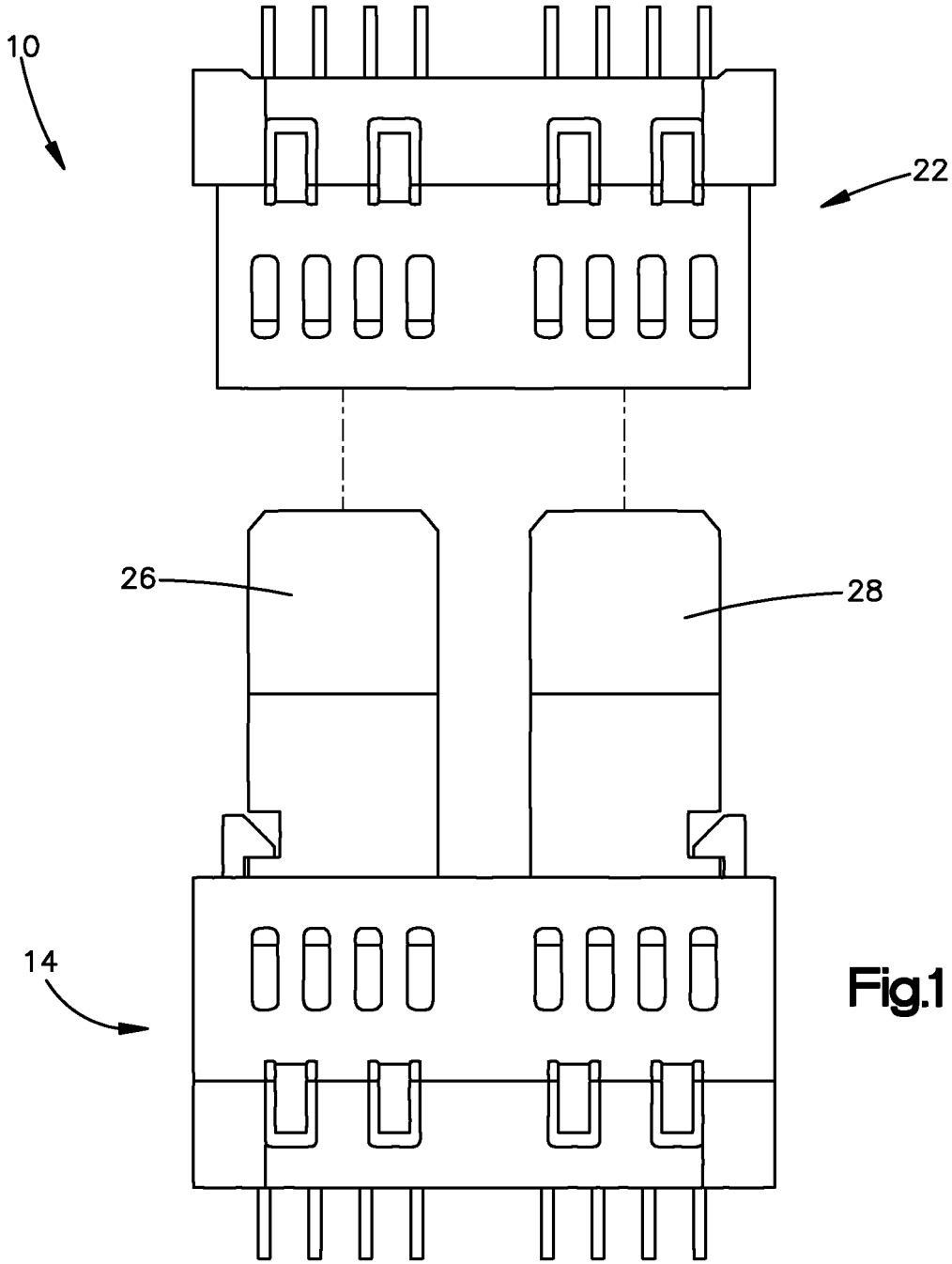
FIG. 1 is a top plan view of an electrical power connector assembly in accordance with an embodiment, the electrical power connector assembly including a first power connector, first and second busbars, and a second power connector electrically coupled to the first power connector by the first and second busbars.

Referring to FIG. 1, an electrical connector assembly 10 can include a first electrical connector 14, a second electrical connector 22, and at least one busbar such as first and second electrically conductive busbars 26 and 28, respectively, that is configured to electrically couple the first electrical connector 14 to the second power connector 22. As shown in FIG. 1, each busbar 26 and 28 is configured to be received by the first electrical connector 14 such that the busbars 26 and 28 mate with the first electrical connector 14. Each busbar 26 and 28 is further configured to be received by the second electrical connector 22 such that the busbars 26 and 28 mate with the second electrical connector 22. Thus, the busbars 26 and 28 are configured to transmit at least electrical power between the first and second electrical connectors 14 and 22. It should be appreciated that the first and second electrical connectors 14 and 22 are configured to be mounted or electrically connected to complementary first and second electrical devices, such as respective substrates, for example. Accordingly, when the busbars 26 and 28 are mated with the first and second electrical connectors 14 and 22, and the first and second connectors 14 and 22 are mounted to the complementary first and second electrical devices, the first and second electrical devices are placed in electrical communication with each other. It should further be appreciated, that the busbars 26 and 28 can be configured to transmit signals between the first and second electrical connectors 14 and 22.

Further, the first and second busbars 26 and 28 can be configured to attach to one of the electrical connectors, such as the first electrical connector 14. Accordingly, when it is desired to unmate the busbars 26 and 28 from the second electrical connector 22, the first electrical connector 14 can be moved away from the second electrical connector 22, which causes the busbars 26 and 28 to move with the first electrical connector 14 such that the busbars 26 and 28 withdraw from the second electrical connector 22. It should be appreciated that while the electrical power assembly 10 includes first and second busbars 26 and 28 that electrically couple the first electrical connector 14 to the second electrical connector 22, the first and second electrical connectors 14 and 22 can be electrically coupled with only a single busbar, such as the first busbar 26.

The electrical connector assembly 10 can be configured to be a cost effective DC power solution for tall (for instance greater than 35.0 mm) mezzanine applications. The electrical connector assembly 10 can have a high current capacity (i.e. greater than 60 A) and provide a low profile to ensure minimum blockage to forced air cooling. It should be appreciated, however, that the assembly 10 can have any configuration as desired. For example, the assembly 10 can be configured for AC power solutions and can be configured for mezzanine applications that are less than 35.0 mm.

Now referring to FIGS. 2A-2D, the first electrical connector 14 can be configured as a receptacle connector. As shown, the first electrical connector 14 can include a first electrically insulative connector housing 40, a first row 42 of power contacts 44 supported by the first housing 40, and a second row 46 of power contacts 48 supported by the first housing 40 at a location spaced from the first row 42 along a first or transverse direction T. For example, the first row 42 of power contacts 44 can be disposed above the second row 46 of power contacts 48, as illustrated, and can be referred to as a "top" or "upper" row, while the second row 46 can be referred to as a "bottom" or "lower" row.

Each power contact 44 and 48 is electrically conductive and extends through the first housing 40 along a second or lateral direction A that is perpendicular to the first direction T. Each power contact 44 and 48 can define at least one mating end 50 such as at least two mating ends 50 and at least one mounting end 52 such as at least two mounting ends 52. The mating ends 50 can be defined by respective beams and the mounting ends 52 can be configured to mount onto a substrate such as a printed circuit board. As shown in FIG. 2C, the first and second rows 42 and 46 of power contacts 44 and 48 extend along a third or longitudinal direction L that is perpendicular to both the first and second directions T and A such that it can be said that the first electrical power connector 14 includes a first row of electrically conductive mating ends 50 and a second row of electrically conductive mating ends 50 that each extend along the third direction. It should be appreciated, that the contacts 44 and 48 can include any number of mating ends 50 and any number of mounting ends 52 as desired. Moreover it should be appreciated, that the first electrical power connector 14 can be configured as a vertical or mezzanine connector as illustrated or can be a right angle connector as desired.

Figure 2A:
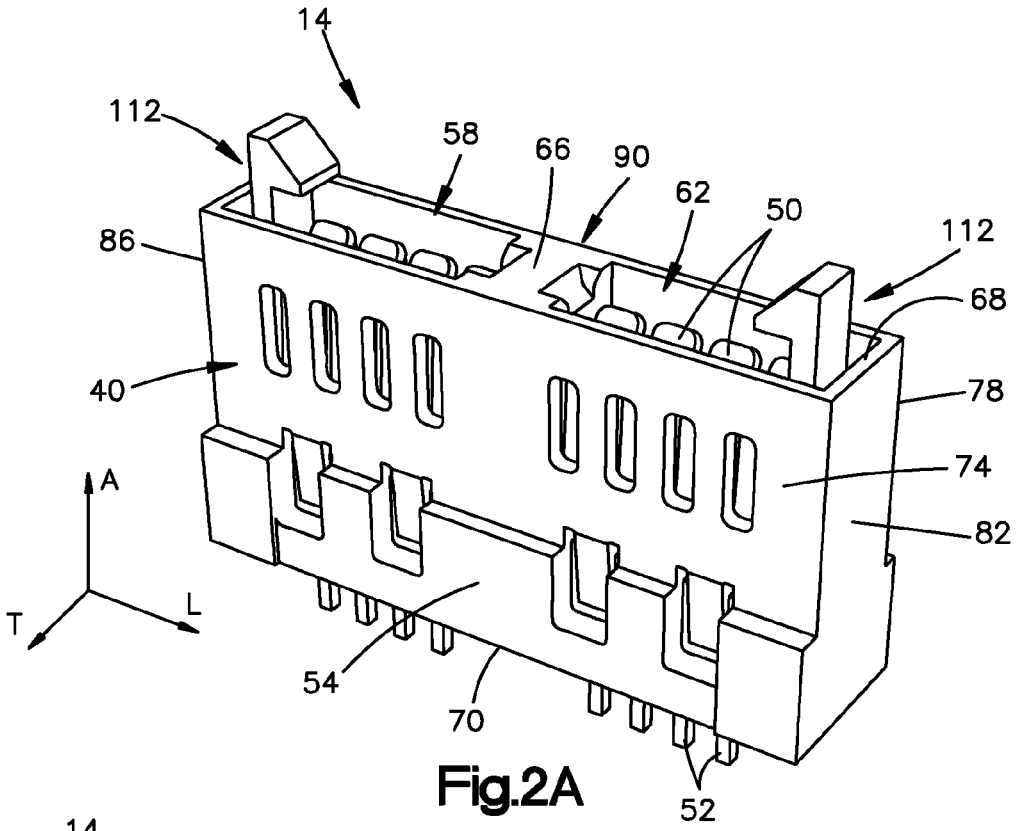
FIG. 2A is a perspective view of the first power connector shown in FIG. 1, the first power connector including a housing body that defines a first receptacle and a second receptacle, and carries first and second attachment members that extend from opposed ends of the housing body.
Figure 2B:
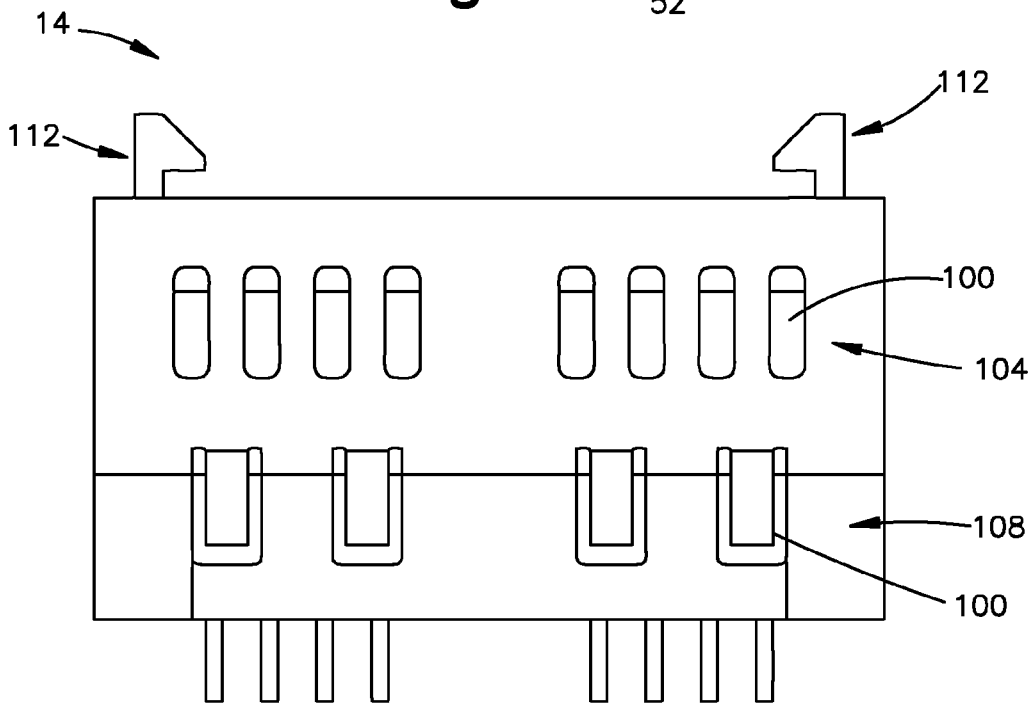
FIG. 2B is a top plan view of the first power connector shown in FIG. 2A.
Figure 2C:
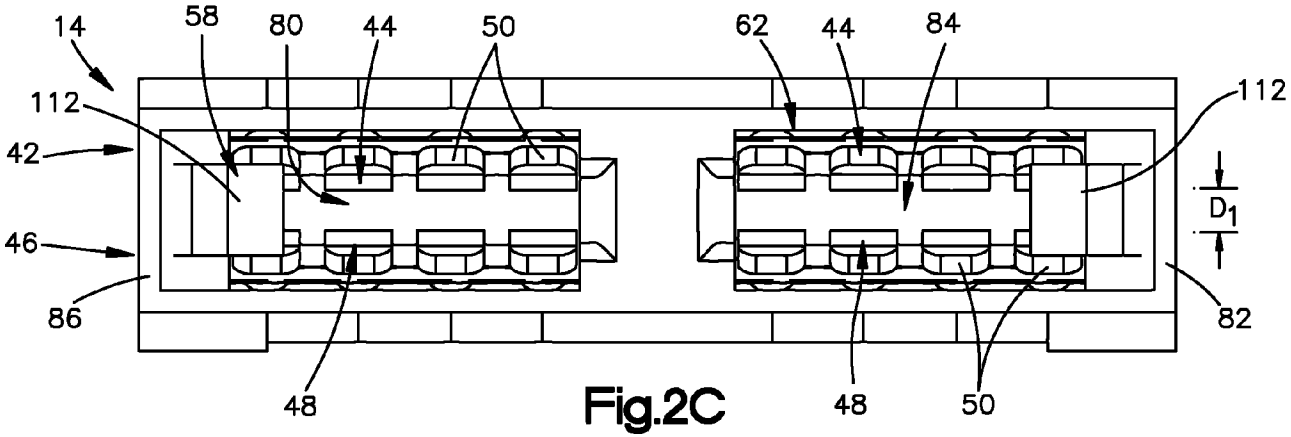
FIG. 2C is a front elevation view of the first power connector shown in FIG. 2A.

As shown in FIGS. 2A-2C, the first connector housing 40 is elongate along the third direction L, and further defines laterally opposed front and rear ends 68 and 70, respectively, transverse opposed upper and lower ends 74 and 78, respectively, and longitudinally opposed end walls 82 and 86, respectively. The front end 68 defines a first mating interface 90 that is configured to mate with the first and second busbars 26 and 28.

As shown in FIGS. 2A and 2B, the first connector housing 40 includes a first housing body 54 that defines a first receptacle 58 and a second receptacle 62 that is spaced from the first receptacle 58 along the third direction L. The first and second receptacles 58 and 62 at least partially define the first mating interface 90. As shown in FIG. 2B, the housing body 54 includes a divider 66 that separates the first receptacle 58 from the second receptacle 62 along the third direction L. The divider 66 can be continuous such that a barrier is defined between the first and second receptacles 58 and 62 along the entire lateral length of the first and second receptacles 58 and 62, or the divider 66 can be segmented such that portions of the first and second receptacles 58 and 62 are exposed to each other. While the first housing 40 is illustrated as having first and second receptacles 58 and 62, it should be appreciated, that the first housing 40 can have only a first receptacle 58, as desired.

As shown in FIG. 2B, the mating ends 50 of at least one power contact 44 of the first row 42 and the mating ends 50 of at least one power contact 48 of the second row 46 are at least partially disposed in the first receptacle 58 so as to define a first slot 80 that extends along the first direction T between the mating ends 50 of the first row 42 and the mating ends 50 of the second row 46. Similarly, the mating ends 50 of a second at least one power contact 44 of the first row 42 and the mating ends 50 of a second at least one power contact 48 of the second row 46 are at least partially disposed in the second receptacle 62 so as to define a second slot 84 that extends along the first direction T between the mating ends 50 of the second at least one power contact 44 of the first row 42 and the mating ends 50 of the second at least one power contact 48 of the second row 46.

The first and second slots 80 and 84 have a height $D_1$ along the transverse direction and are configured to receive the first and second busbars 26 and 28, respectively. The mating ends 50 are flexible between an unmated position and a mated position whereby the height $D_1$ when in the mated position is greater than the height $D_1$ when in the unmated position. That is, the height $D_1$ of the first and second slots 80 and 84 can be less than the thicknesses of the first and second busbars 26 and 28 such that when the first and second slots 80 and 84 receive the first and second busbars 26 and 28, the height $D_1$ of the first and second slots 80 and 84 expand to accommodate the busbars 26 and 28. When the busbars 26 and 28 are received by the first and second slots 80 and 84, the mating ends 50 bias toward the unmated position thereby creating a frictional fit with the busbars 26 and 28.

As shown in FIG. 2C, the upper and lower ends 74 and 78 of the first connector housing 40 include longitudinally extending rows of ventilation windows 100 that extend transversely through the housing body 54. In particular, the upper and lower ends 74 and 78 each include a first row 104 of ventilation windows 100 that are laterally elongate, and extend transversely through the upper and lower ends 74 and 78 such that the windows 100 that extend through the upper end 74 are aligned with the windows 100 that extend through the lower end 78. The upper and lower ends 74 and 78 of the housing connector 40 can further include a second row 108 of windows 100 that are laterally offset from the first row 104 of windows 100. It should be appreciated, however, that the first connector housing 40 can include any number of rows of windows 100 or can be void of windows 100, as desired.

With continued reference to FIGS. 2A-2D, the first connector housing 40 can include first and second attachment members 112 that are configured to attach the first and second busbars 26 and 28 to the first housing 40. That is, the housing body 54 can carry first and second attachment members 112 that are configured to lockingly attach the first and second busbars 26 and 28 to the first electrical power connector 14. As shown, the first and second attachment members 112 can be spaced from each other along the third direction L and can extend from the end walls 82 and 86, respectively.

Figure 2D:
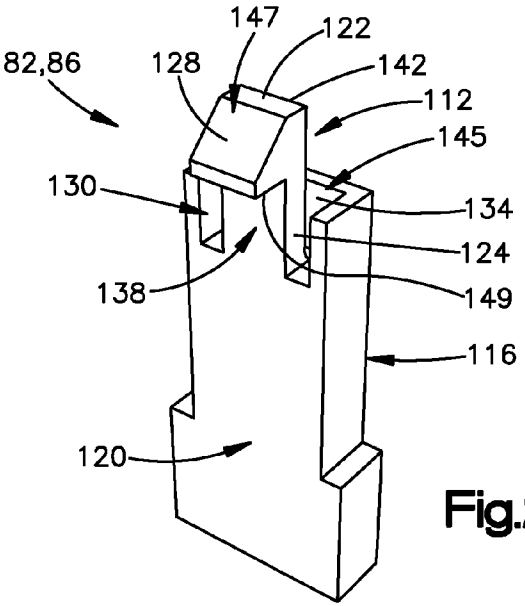
FIG. 2D is a detailed perspective view of one of the first and second attachment members of the first power connector shown in FIG. 2A.

As shown in FIG. 2D, each end wall 82 and 86 of the first connector housing 40 defines an outer surface 116 and an inner surface 120 that is spaced from the outer surface 116 along the third direction L. The inner surfaces 120 at least partially define the first and second receptacles 58 and 62. As shown in FIG. 2D, each of the first and second attachment members 112 is configured as a latch 122 that includes an arm 124 and a protrusion 128 that extends from the arm 124. In particular, the arms 124 extend out their respective receptacles 58 and 62 along the second direction A, such that the protrusions 128 are spaced form the housing body 54 along the second direction A. It should be appreciated, however, that the arms 124 can extend from any portion of the housing body 54, as desired. For example, the arms 124 can extend from the divider 66 or from a location that is external to the receptacles 58 and 62.

With continued reference to FIG. 2D, each end wall 82 and 86 includes a pocket 130 that is partially defined by an internal surface 134 that is spaced from the inner surface 120 and the outer surface 116 along the third direction L such that the internal surface 134 is between the inner and outer surfaces 120 and 116. The arms 124 extend from the pockets 130 such that an inner surface 138 of each arm 124 is flush with the respective inner surface 120, and an outer surface 142 of each arm 124 is spaced from the respective internal surface 134 along the third direction L such that a respective gap 145 is defined between each arm 124 and each internal surface 134. The gaps 145 can be defined along a majority of the lateral length of the end walls 82 and 86 or along a minor portion as illustrated. It should be appreciated, however, that the latches 122 can extend from portions of the housing body 54 such that no gaps 145 are present. For example, the latches 122 can extend from the front end 68 of the first housing 40.

The gaps 145 allow for the arms 124 to flex outwardly as the busbars 26 and 28 are being inserted into their respective slots 80 and 84. That is, each arm 124 can be resiliently flexible between an insertion position and a latched position such that as the busbars 26 and 28 are inserted into the first and second slots 80 and 84, the busbars 26 and 28 bias the latches 122 outward such that the protrusions 128 ride along respective outer surfaces of the busbars 26 and 28 until the busbars 26 and 28 are fully inserted into the slots 80 and 84, whereby the protrusions are aligned with corresponding attachment members of the busbars 26 and 28 and the arms 124 spring bias inward so as to attach the busbars 26 and 28 to the first electrical connector 14.

The protrusions 128 can extend from the arms 124 along the third direction L such that the protrusions 128 of the first and second attachment members 112 face each other along the third direction L. Each protrusion 128 can include an inner sloped surface 147 that slopes from respective outer surface 142 and toward a longitudinal centerline of the first housing 40. Therefore, the inner sloped surfaces 147 of the first and second attachment members 112 slope toward each other as they extend inward. Each sloped surface 147 can terminate at an abutment surface 149 that faces the respective first and second receptacles 58 and 62. The sloped surfaces 147 are configured to ride against the respective outer surfaces of the busbars 26 and 28, and the abutment surfaces 149 are configured to abut respective abutment surfaces of the busbars 26 and 28 to thereby lockingly attach the busbars 26 and 28 to the first electrical connector 14. In this way it can be said that the first and second attachment members 112 are configured to mate with respective attachment members of the busbars 26 and 28 to thereby interfere with the busbars 26 and 28 so as to prevent the busbars 26 and 28 from moving along a withdrawal direction that is opposite the insertion direction with respect to the first connector housing 40. The withdrawal direction can be parallel to the second direction A.

It should be appreciated, however, that the first and second attachment members 112 can have other configurations, as desired. For example, the first and second attachment members 112 can be recesses or clips. Moreover, it should be appreciated that the first and second attachment members 112 can be disposed on opposed ends of the first receptacle 58 and can be configured to mate with respective attachment members of the first busbar 26 so as to prevent the busbar 26 from moving in the second direction with respect to the first housing 40. Therefore, the first housing 40 can define one or any number of receptacles and can include one or any number attachment members 112 that are configured to engage a single busbar or two or more busbars. Further, it should be appreciated that while the illustrated latches 122 are resiliently flexible, the latches 122 can include other structure that allows them to be flexible. For example the latches 122 can be connected to the housing body by a torsion spring that urges the latch toward the busbar.

Figure 3A:
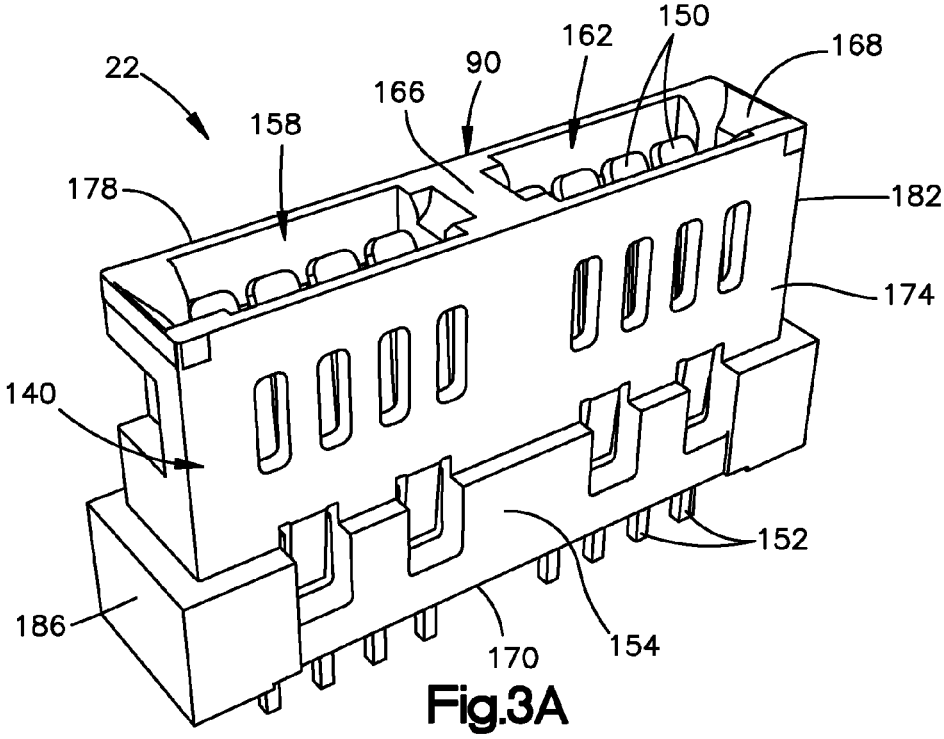
FIG. 3A is a perspective view of the second power connector shown in FIG. 1, the second power connector including a housing body that defines a first receptacle and a second receptacle.
Figure 3B:
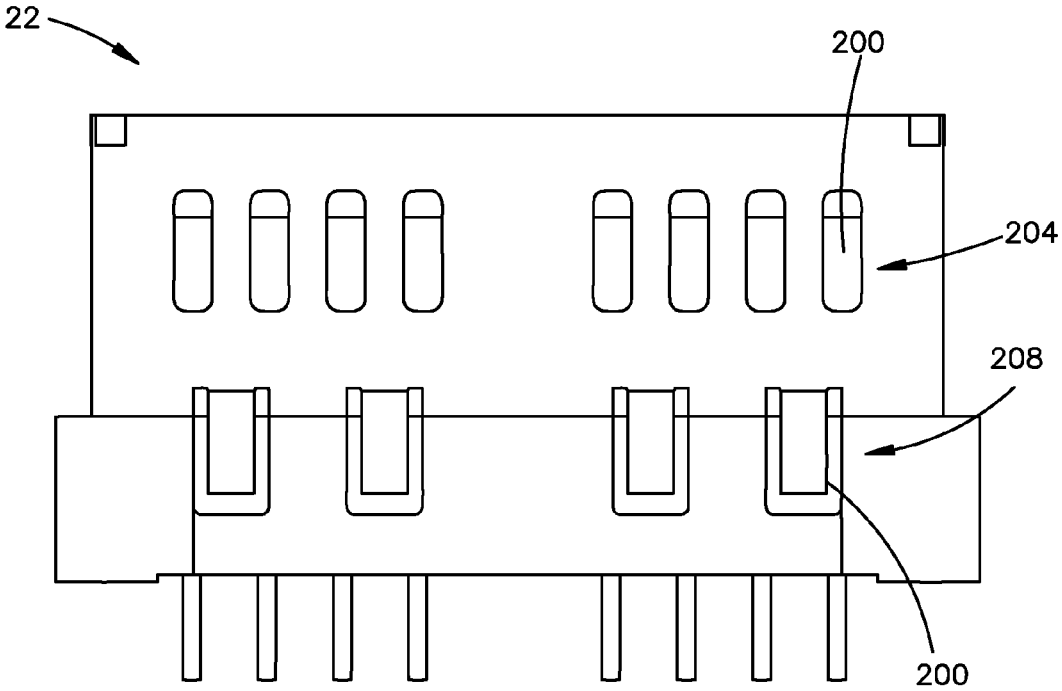
FIG. 3B is a top plan view of the second power connector shown in FIG. 3A.
Figure 3C:
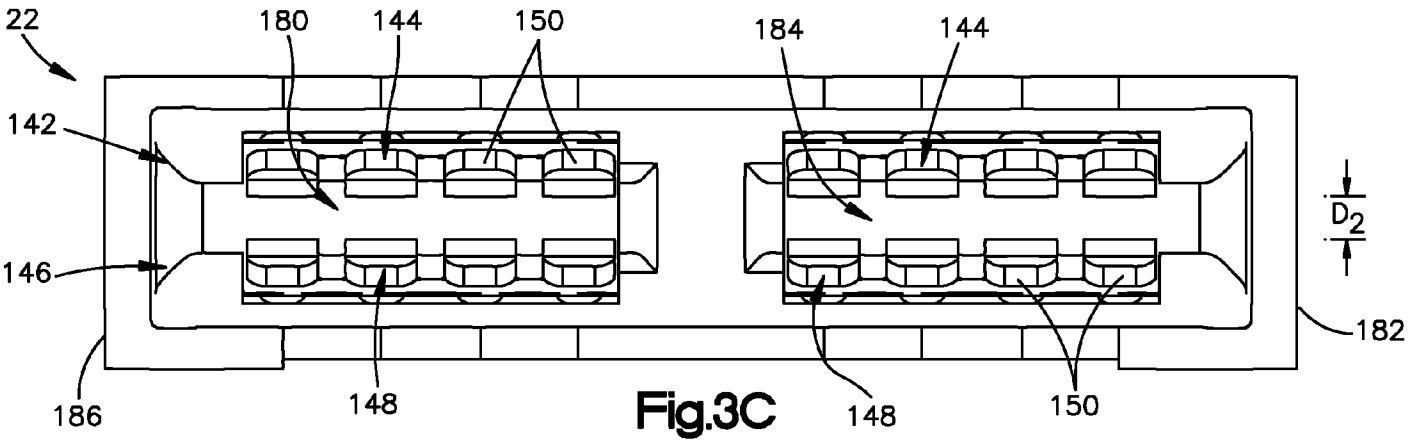
FIG. 3C is a front elevation view of the second power connector shown in FIG. 3A.

Now referring to FIGS. 3A-3C, the second electrical connector 22 can also be configured as a receptacle connector. The second electrical connector 22 can be substantially identical as the first electrical connector 14 and can include like structure unless otherwise stated. As shown, the first electrical connector can include a second electrically insulative connector housing 140, a first row 142 of power contacts 144 supported by the second connector housing 140, and a second row 146 of power contacts 148 supported by the second connector housing 140 at a location spaced from the first row 142 along the first direction T. For example, the first row 142 of power contacts 144 can be disposed above the second row 146 of power contacts 148, as illustrated, and can be referred to as a "top" or "upper" row, while the second row 146 can be referred to as a "bottom" or "lower" row.

Each power contact 144 and 148 is electrically conductive and extends through the second connector housing 140 along the second direction A. Each power contact 144 and 148 can define at least one such as at least two mating ends 150 and at least one such as at least two mounting ends 152. Each mating end 150 can be defined by a respective beam and the mounting ends 152 can be configured to mount onto a substrate such as printed circuit board. As shown in FIG. 3B, the first and second rows 142 and 146 of power contacts 144 and 148 extend along the third direction L such that it can be said that the second electrical power connector 22 includes a first row of electrically conductive mating ends 150 and a second row of electrically conductive mating ends 150. It should be appreciated, that the contacts 144 and 148 can include any number of mating ends 150 and any number of mounting ends 152 as desired. Moreover it should be appreciated, that the second electrical connector 22 can be configured as a vertical or mezzanine connector as illustrated or can be a right angle connector as desired.

As shown in FIGS. 3A and 3B, the second connector housing 140 is elongate along the third direction L, and further defines laterally opposed front and rear ends 168 and 170, respectively, transverse opposed upper and lower ends 174 and 178, respectively, and longitudinally opposed end walls 182 and 186, respectively. The front end 168 defines a second mating interface 190 that is configured to mate with the first and second busbars 26 and 28.

As shown in FIGS. 3A and 3B, the second connector housing 140 includes a second housing body 154 that defines a first receptacle 158 and a second receptacle 162 that is spaced from the first receptacle 158 along the third direction L. The housing body 154 includes a divider 166 that separates the first receptacle 158 from the second receptacle 162 along the third direction L. The divider 166 can be continuous such that a barrier is defined between the first and second receptacles 158 and 162 along the entire lateral length of the first and second receptacles 158 and 162, or the divider 166 can be segmented such that portions of the first and second receptacles 158 and 162 are exposed to each other. While the second connector housing 140 is illustrated as having first and second receptacles 158 and 162, it should be appreciated, that the second connector housing 140 can have only a first receptacle 158, as desired.

As shown in FIG. 3B, the mating ends 150 of at least one power contact 144 of the first row 142 and the mating ends 150 of at least one power contact 148 of the second row 146 are at least partially disposed in the first receptacle 158 so as to define a first slot 180 that extends along the first direction T between the mating ends 150 of the first row 142 and the mating ends 150 of the second row 146. Similarly, the mating ends 150 of a second at least one power contact 144 of the first row 142 and the mating ends 150 of a second at least one power contact 148 of the second row 146 are at least partially disposed in the second receptacle 162 so as to define a second slot 184 that extends along the first direction T between the mating ends 150 of the second at least one power contact 144 of the first row 142 and the mating ends 150 of the second at least one power contact 148 of the second row 146.

The first and second slots 180 and 184 have a height $D_2$ along the transverse direction T, and are configured to receive the first and second busbars 26 and 28, respectively. The mating ends 150 are flexible between an unmated position and a mated position whereby the height $D_2$ when in the mated position is greater than the height $D_2$ when in the unmated position. That is, height $D_2$ of the first and second slots 180 and 184 can be less than the thicknesses of the first and second busbars 26 and 28 such that when the first and second slots 180 and 184 receive the first and second busbars 26 and 28, the height $D_2$ of the first and second slots 180 and 184 expand to accommodate the busbars 26 and 28. When the busbars 26 and 28 are received by the first and second slots 180 and 184, the mating ends 150 bias toward the unmated position thereby creating a frictional fit with the busbars 26 and 28.

As shown in FIG. 3C, the upper and lower ends 174 and 178 of the second connector housing 140 include longitudinally extending rows of ventilation windows 200 that extend transversely through the housing body 154. In particular, the upper and lower ends 174 and 178 each include a first row 204 of ventilation windows 200 that are laterally elongate, and extend transversely through the upper and lower ends 174 and 178 such that the windows 200 that extend through the upper end 174 are aligned with the windows 200 that extend through the lower end 178. The upper and lower ends 174 and 178 of the second connector housing 140 can further include a second row 208 of windows 200 that are laterally offset from the first row 204 of windows 200. It should be appreciated, however, that the second connector housing 140 can include any number of rows of windows 200 or can be void of windows 200, as desired.

Figure 4C:
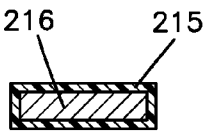
FIG. 4C is a cross-sectional view of the busbar shown in FIG. 4B through the line 4C-4C.
Figure 4B:
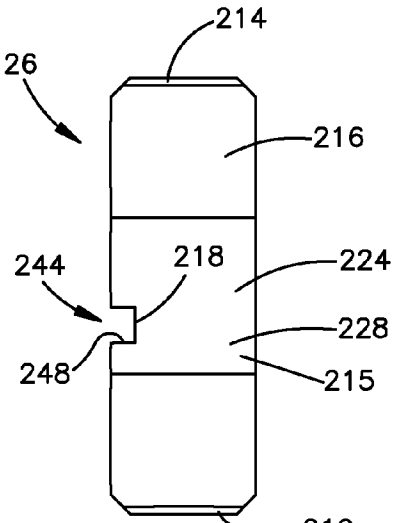
FIG. 4B is a bottom plan view of the busbar shown in FIG. 4A.
Figure 4A:
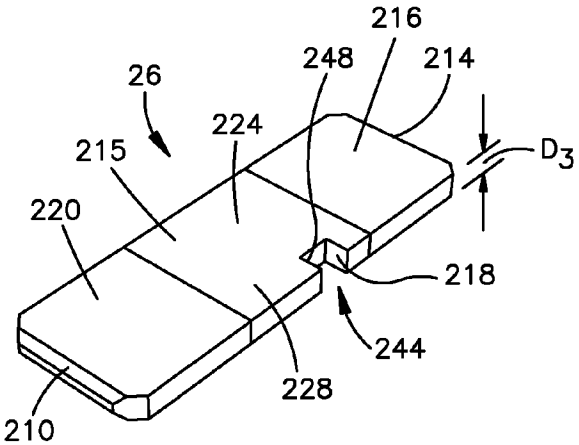
FIG. 4A is a perspective view of one of the first and second busbars shown in FIG. 1, the busbar including an attachment member configured to mate with the first or second attachment member of the first power connector.

Now in reference to FIGS. 4A-4C, the first busbar 26 is electrically conductive and includes an insulative busbar housing 215 and an electrically conductive busbar contact 216 supported by the busbar housing 215. The busbar contact 216 can have a first end 210 and a second end 214 opposite the first end 210. The first busbar 26 can further define an attachment member 218 that is configured to mate with the first attachment member 112 so as to attach the busbar 26 to the first housing 40. The first end 210 of the busbar contact 216 is configured to be received by the first receptacle 58 of the first electrical connector 14 in a mating direction that is substantially parallel to the second direction such that the first end 210 of the busbar contact 216 is brought into physical and electrical contact with each of the at least two mating ends 50 of each of the first and second rows 42 and 46 in the first slot 80. The second end 214 of the busbar contact 216 is configured to be received by the first receptacle 158 of the second electrical connector 22 in a mating direction that is parallel to the second direction such that the second end 214 of the busbar contact is brought into physical and electrical contact with the at least two mating ends 150 of each of the first and second rows 142 and 146 in the first slot 180. In this way, the busbar 26 commons the mating ends 50 and the mating ends 150 along a longitudinal length of the busbar 26. Moreover, at least the mating ends 50 can remain commoned along a longitudinal length of the first end of the busbar 26. It should be appreciated, however, that the first busbar 26 can include a plurality of busbar contacts 216 supported by the busbar housing 215, such that each busbar contact 216 is brought into physical and electrical contact with the at least two mating ends of a respective contact. Further it should be appreciated, that the busbar contact 216 can be monolithic or can include an intermediate conductive element between the first and second ends.

The busbar contact 216 can include a busbar contact body 220 that defines a middle portion 224 between the first end 210 and the second end 214. The busbar housing 215 can be configured as an electrically insulative material 228 that surrounds an outer surface 232 of the busbar contact body 220 at the middle portion 224, such that the first end 210 is in electrical communication with the second end 214. The busbar contact 216 can have a thickness $D_3$ measured along the first direction that is greater than the height of the slots when the mating ends are in the unmated position. In the illustrated embodiment the busbar contact 216 has a thickness that is between about 1.5 mm and about 2.0 mm. It should be appreciated, however, that the busbar 26 can have any thickness as desired.

As shown in FIG. 4B, the busbar 26 can include at least one attachment member 218 that is configured to mate with the first attachment member 112 so as to attach the busbar 26 to the first housing 40. The attachment member 218 of the busbar 26 can be configured as a recess 244 and can be sized to receive the protrusion 128 so as to cause the attachment member 218 of the busbar 26 to mate with the first attachment member 112. In particular, the recess 244 can be at least partially defined by an abutment surface 248 that is configured to abut the abutment surface 149 of the protrusion 128 to thereby lockingly attach the busbar 26 to the first electrical connector 14. As shown, the attachment member 240 can extend into the middle portion 224 as illustrated or can extend into any portion of the busbar contact body 220 or busbar housing 215 as desired. It should be appreciated, however, that the attachment member 240 can have any configuration as desired. For example, the attachment member 240 can be configured as a latch that extends out from the busbar contact body 220 or busbar housing 215.

It should be appreciated that the second busbar 28 can be identical to the first busbar 26 and that the first and second ends of the second busbar's electrically conductive busbar contact can be received by the second receptacles 62 and 162 of the first and second electrical connectors 14 and 22 in respective mating directions such that the first end 210 of the busbar contact is brought into physical and electrical contact with the at least two mating ends 50 of each of the first and second rows 42 and 46 in the second slot 84 and the second end 214 of the busbar contact is brought into physical and electrical contact with the at least two mating ends 150 of each of the first and second rows 142 and 146 in the second slot 184. It should be appreciated, however, that the first and second busbars 26 and 28 can have different structure as desired. For example, the busbars 26 and 28 can have different lengths, different widths, different material thicknesses, can be made from different materials, and can have different electrical conductivities. Moreover, one of the busbars can also be another electrical device, such as an LED circuit. Also, one of the busbars can include a port or can otherwise have power drawn from it to a third connector or device that is separate from the first and second electrical power connectors. The busbars 26 and 28 can be removable and/or interchangeable. The busbars can be removable along any direction for example along the longitudinal direction. If the busbars are shortened to thereby shorten the stack height it may be desirable to increase the thickness of the busbars or improve cooling of the busbars. Alternatively, if the stack height is to be shortened, additional busbars can be added. It should also be appreciated that the first and second busbars can be manufactured as being preformed to have a particular carrying capacity.

Figure 5:
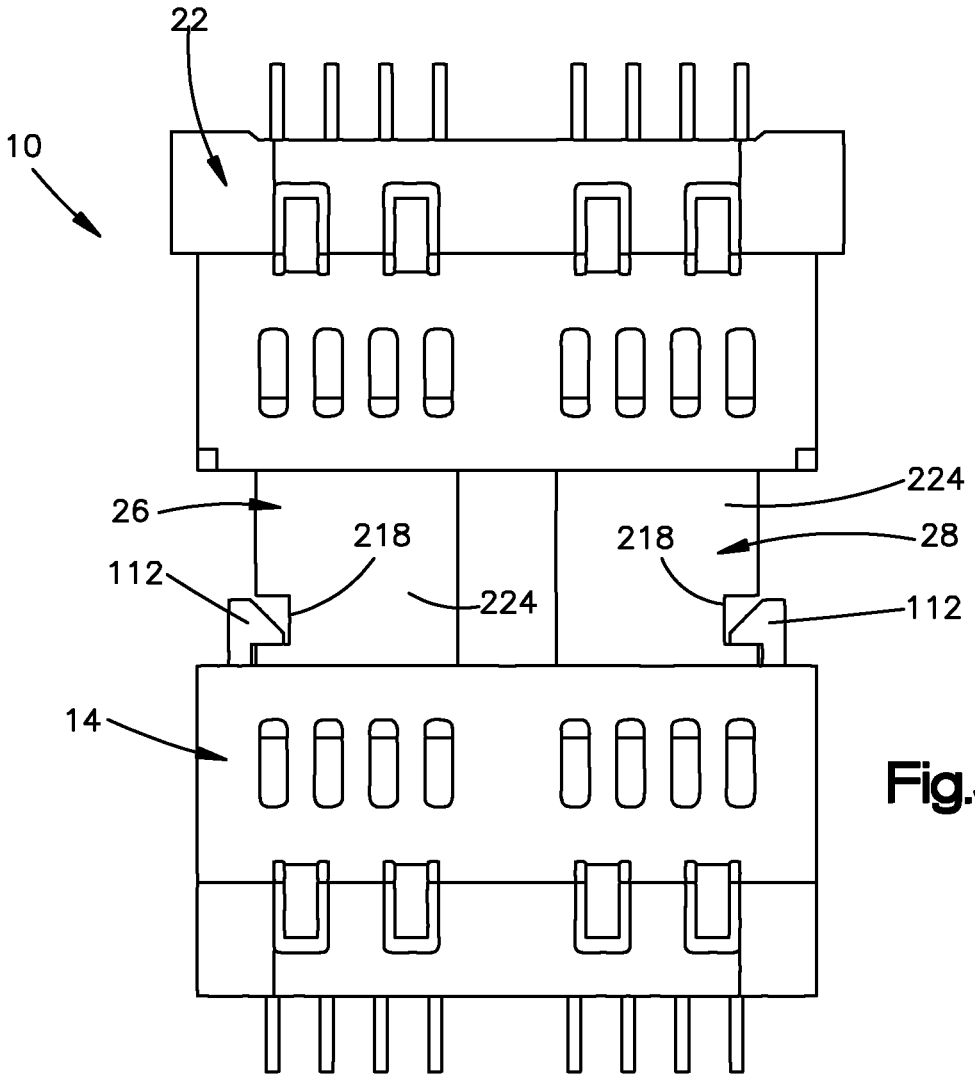
FIG. 5 is a top plan view of the first and second busbars received in the first and second receptacles of the first and second power connectors such that the first and second attachment members of the first power connector are mated with the attachment members of the first and second busbars, respectively, to thereby attach the first and second busbars to the first power connector.

As shown in FIG. 5, when the first and second busbars 26 and 28 are fully received by the first and second slots 80, 84 and 180, 184 of the first and second electrical connectors 14 and 22, the busbars 26 and 28 lockingly attach to the first electrical connector 14, such that as the first electrical connector is moved away from the second electrical connector 22, the busbars 26 and 28 move with the first electrical connector 14 such that the second ends of the busbars 26 and 28 withdraw from the first and second slots 180 and 184 of the second electrical connector 22. That is, when the first ends of the busbar contacts are fully received in the slots 80 and 84 of the first electrical connector and the second ends of the busbar contacts are fully received in the slots 180 and 184 of the second electrical connector, the busbars 26 and 28 lockingly attach to the first electrical connector such that as the first and second electrical connectors are separated from each other the busbars remain attached to the first electrical connector and the second ends withdraw from the slots of the second electrical connector. As shown in FIG. 5, the busbars 26 and 28 can be inserted into the slots a depth such that only the insulated middle portions 224 are external to the receptacles or are otherwise exposed. It should be appreciated, however, that portions of the insulated portions 224 may be disposed within the receptacles or even the slots as desired or alternatively portions of non-insulated portions of the busbars 26 and 28 can be exposed as desired.

Therefore in accordance with the illustrated embodiment, a method of electrically connecting a first receptacle power connector 14 to a second receptacle power connector 22 can include inserting a first end of an electrically conductive busbar into a slot defined between first and second rows of electrically conductive mating ends of a first electrical receptacle connector such that the busbar attaches to the first electrical receptacle connector; and inserting a second end of the busbar into a slot defined between first and second rows of electrically conductive mating ends of a second electrical receptacle connector such that when the first electrical receptacle connector is moved away from the second electrical receptacle connector, the busbar moves with the first electrical receptacle connector and the second end withdraws from the second electrical connector. The method can further comprise causing a first latch of the first electrical receptacle connector to flex outwardly as the first end of the busbar is inserted into the slot of the first electrical receptacle connector.

The first electrical connector 14 and the busbars 26 and 28 form a plug connector when the busbars 26 and 28 are attached to the first electrical connector 14. The plug connector can be configured to only carry power.

Figure 6B:
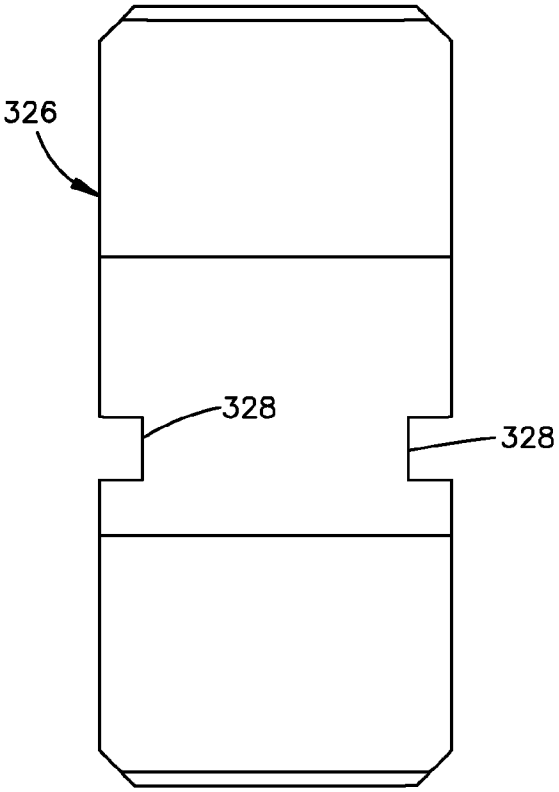
FIG. 6B is a top plan view of the busbar shown in FIG. 6A, the busbar having a pair of attachment members.
Figure 6A:
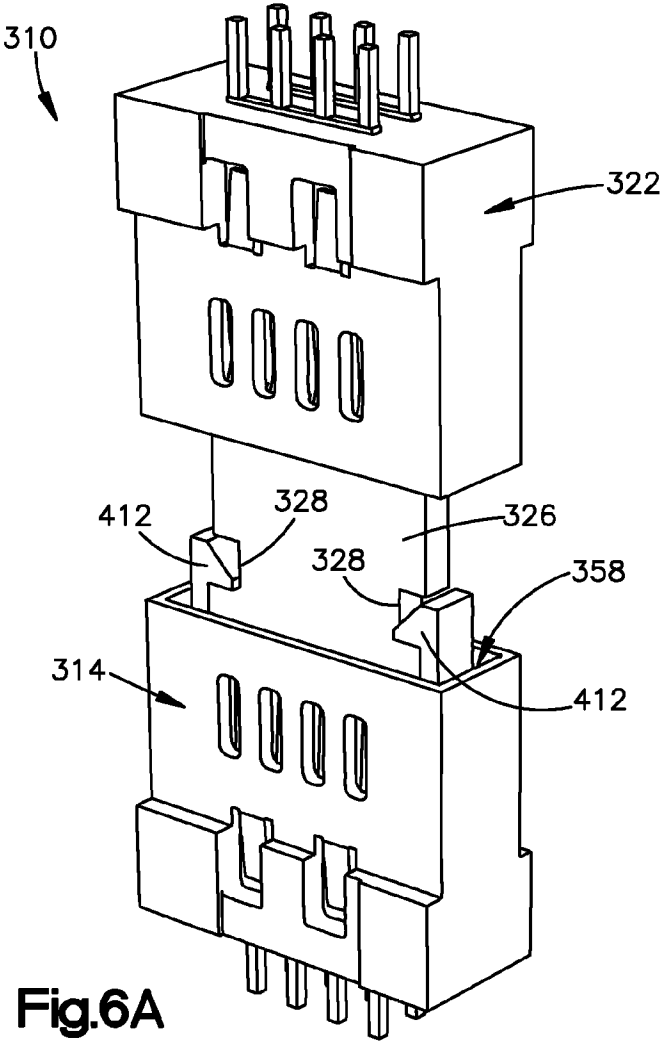
FIG. 6A is a perspective view of an electrical power connector assembly in accordance with another embodiment, the electrical power connector assembly including a first electrical power connector, a first busbar, and a second electrical power connector electrically coupled to the first electrical power connector by the busbar.

Now in reference to FIGS. 6A and 6B, in another embodiment the assembly can be configured to have a single busbar. As shown, an electrical connector assembly 310 can include first and second connectors 314 and 322 that each defines only a first receptacle 358. Therefore, the assembly 310 can include a single busbar 326 that defines a pair of attachment members 328 as shown in FIG. 6B that are configured to be mated with corresponding attachment members 412 of the first connector 314. It should be appreciated, that the electrical connector assembly 310 otherwise includes similar structure and functions in a substantially similar manner as the assembly 10.

Figure 7:
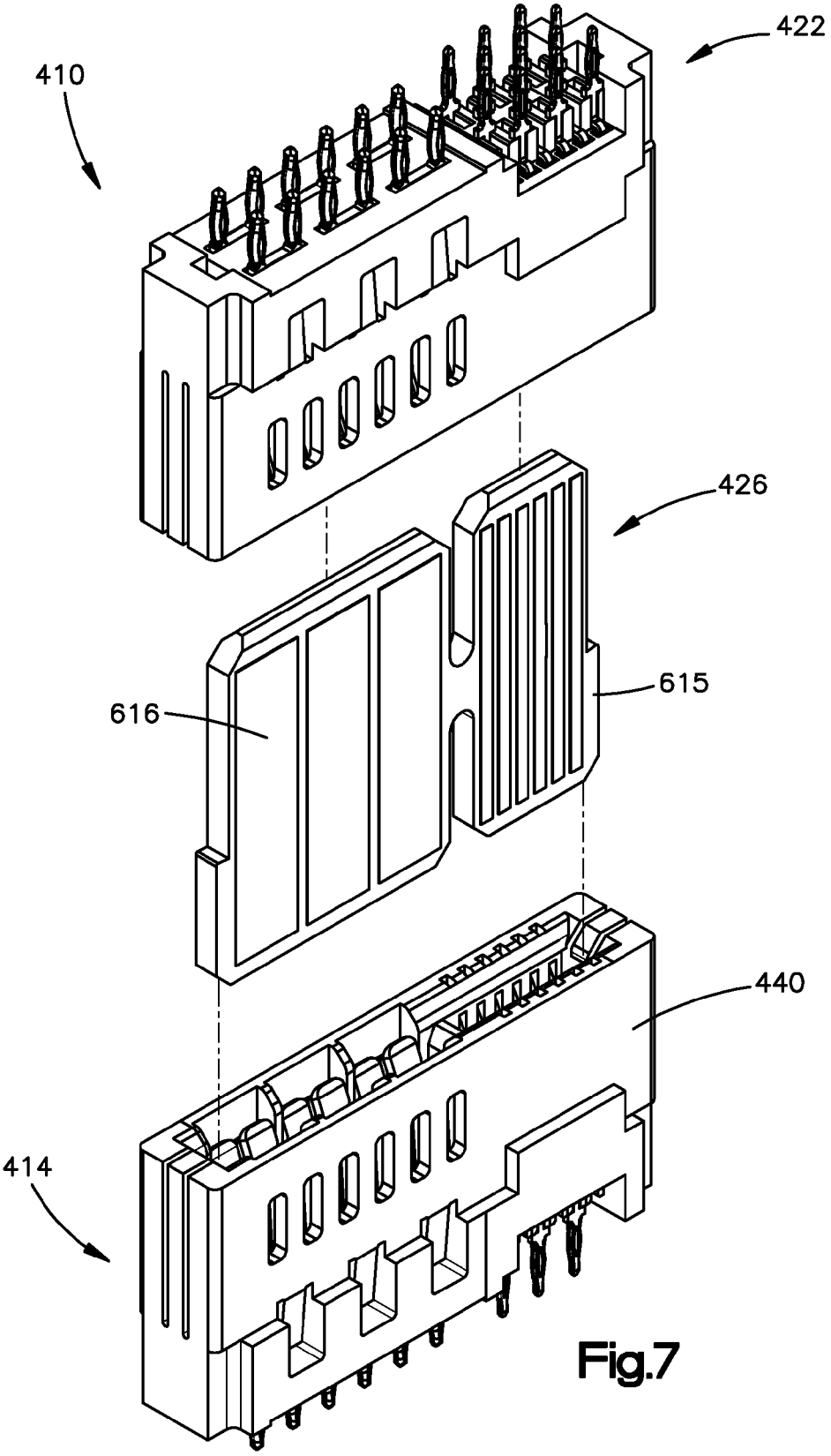
FIG. 7 is a perspective view of an electrical power connector assembly in accordance with another embodiment, the electrical power connector assembly including assembly including a first power connector, a first busbar, and a second power connector electrically coupled to the first power connector by the first busbar.

Now in reference to FIG. 7, an electrical connector assembly 410 can include a first electrical connector 414, a second electrical connector 422, and a busbar 426 that is configured to electrically couple the first electrical connector 414 to the second electrical connector 422. The busbar 426 can be configured to lockingly attach to one of the electrical connectors, such as the first electrical connector 414. Accordingly, when it is desired to unmate the busbar 426 from the second electrical connector 422, the first electrical connector 414 can be moved away from the second electrical connector 422, which causes the busbar 426 to move with the first electrical connector 414 such that the busbar 426 withdraws from the second electrical connector 422. Therefore, the electrical connector assembly 410 includes similar structure and operates in a similar manner as the electrical connector assembly 10 shown in FIG. 1 unless otherwise described.

Now referring to FIGS. 7, 8A-8B and 9A-E, the first electrical connector 414 can be configured as a receptacle connector. As shown, the first electrical connector 414 can include a first electrically insulative connector housing 440, a first row 442*a* of power contacts 444*a* supported by the first housing 440, and a second row 446*a* of power contacts 448*a* supported by the first housing 440 at a location spaced from the first row 442*a* along the first direction T. The first electrical connector 414 can further include a first row 442*b* of signal contacts 444*b* supported by the first connector housing 440, and a second row 446*b* of signal contacts 448*b* supported by the first connector housing 440 at a location spaced from the first row 442*b* along the first direction T.

Each power contact 444*a* and 448*a* is electrically conductive and extends through the first connector housing 440 along the second direction A. Each power contact 444*a* and 448*a* can define at least one mating end 450*a* such as at least two mating ends 450*a* and at least one mounting end 452*a* such as at least two mounting ends 452*a*. The mating ends 450*a* can be defined by respective beams and the mounting ends 452*a* can be configured to mount onto a substrate such as a printed circuit board. As shown in FIG. 9C, the first and second rows 442*a* and 446*a* of power contacts 444*a* and 448*a* extend along the third direction L such that it can be said that the first electrical connector 414 includes a first row of electrically conductive mating ends 450*a* and a second row of electrically conductive mating ends 450*a* that each extend along the third direction.

Each signal contact 444*b* and 448*b* is electrically conductive and extends through the first connector housing 440 along the second direction A. Each signal contact 444*b* and 448*b* can define at least one mating end 450*b* and at least one mounting end 452*b*. The mating ends 450*b* can be defined by respective beams and the mounting ends 452*b* can be configured to mount onto the substrate. As shown in FIG. 9C, the first and second rows 442*b* and 446*b* of signal contacts 444*b* and 448*b* extend along the third direction L such that it can be said that the first electrical connector 414 includes a first row of electrically conductive mating ends 450*b* and a second row of electrically conductive mating ends 450*b* that each extend along the third direction.

As shown in FIGS. 9A-9E, the first connector housing 440 is elongate along the third direction L, and further defines laterally opposed front and rear ends 468 and 470, respectively, transverse opposed upper and lower ends 474 and 478, respectively, and longitudinally opposed end walls 482 and 486, respectively. The front end 468 defines a first mating interface 490 that is configured to mate with the busbar 426.

Figure 9A:
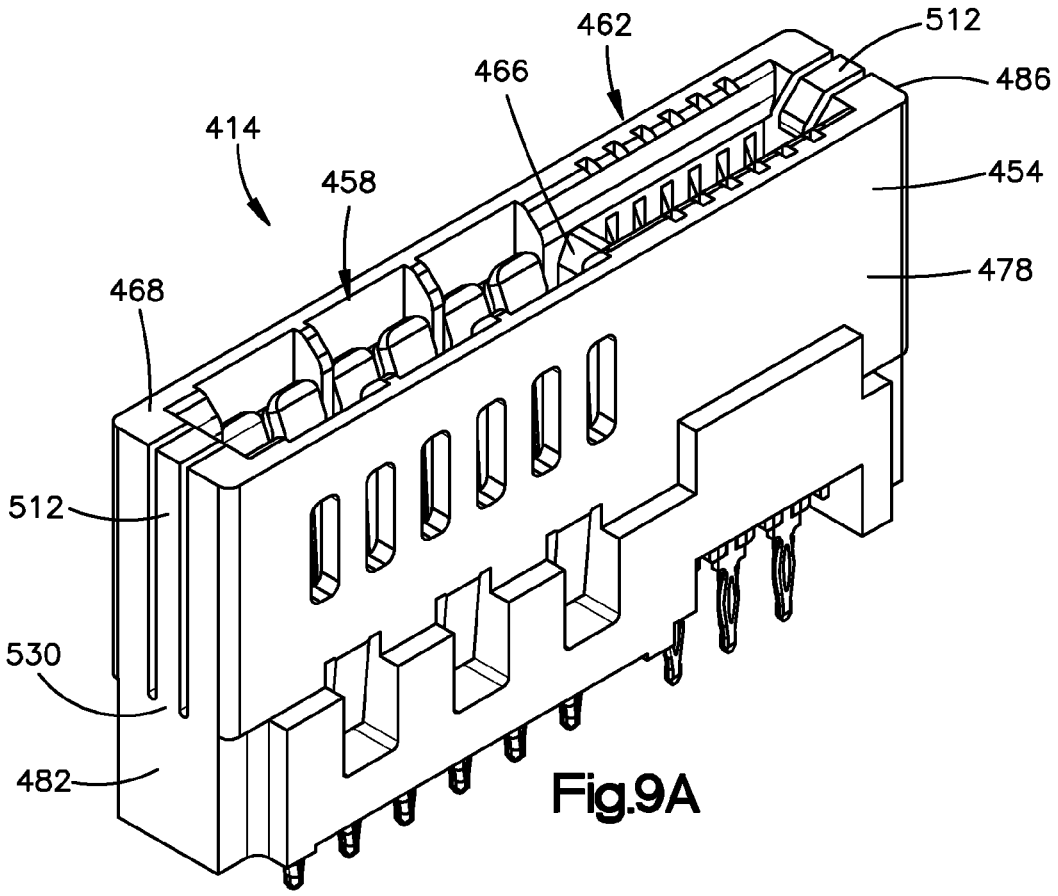
FIG. 9A is a perspective view of the first power connector shown in FIG. 7, the first power connector including a housing body that defines a first receptacle and a second receptacle, and carries first and second attachment members that extend from opposed ends of the housing body.
Figure 9B:
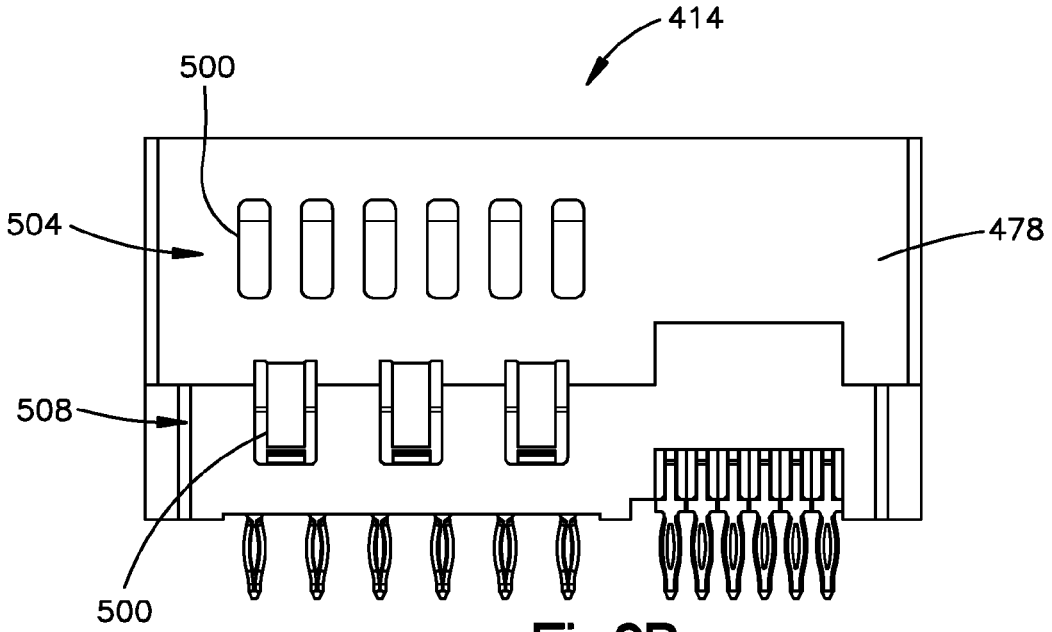
FIG. 9B is a top plan view of the first power connector shown in FIG. 9A.
Figure 9C:
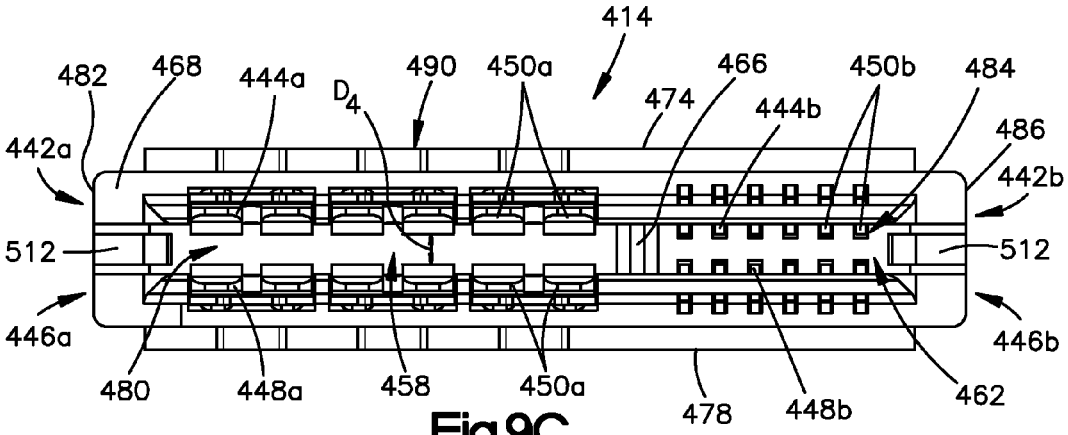
FIG. 9C is a front elevation view of the first power connector shown in FIG. 9A.
Figure 9D:
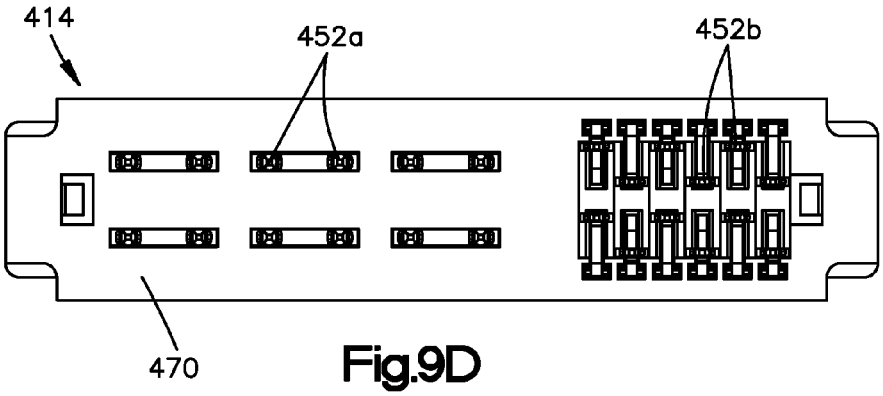
FIG. 9D is a rear elevation view of the first power connector shown in FIG. 9A.
Figure 9E:
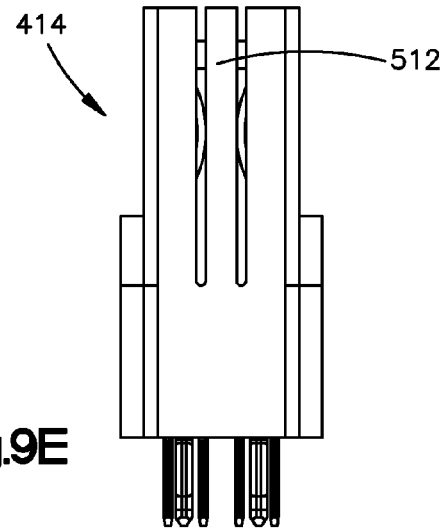
FIG. 9E is a side elevation view of the first power connector shown in FIG. 9A.

As shown in FIGS. 9A and 9C, the first connector housing 440 includes a first housing body 454 that defines a first receptacle 458 and a second receptacle 462 that is spaced from the first receptacle 458 along the third direction L. The first and second receptacles 458 and 462 at least partially define the first mating interface 490. As shown in FIG. 2B, the housing body 454 includes a divider 466 that separates the first receptacle 458 from the second receptacle 462 along the third direction L. The divider 466 can be continuous such that a barrier is defined between the first and second receptacles 458 and 462 along the entire lateral length of the first and second receptacles 458 and 462, or the divider 466 can be segmented such that portions of the first and second receptacles 458 and 462 are exposed to each other. The divider 466 can define an alignment mechanism. It should be appreciated, however, that the housing body 454 can define a gap between the first and second receptacles such that the gap defines the alignment mechanism.

As shown in FIG. 9C, the mating ends 450*a* of at least one power contact 444*a* of the first row 442*a* and the mating ends 450*a* of at least one power contact 448*a* of the second row 446*a* are at least partially disposed in the first receptacle 458 so as to define a first slot 480 that extends along the first direction T between the mating ends 450*a* of the first row 442*a* and the mating ends 450*a* of the second row 446*a*. Similarly, the mating ends 450*b* of a second at least one signal contact 444*b* of the first row 442*b* and the mating ends 450*b* of a second at least one signal contact 448*b* of the second row 446*b* are at least partially disposed in the second receptacle 462 so as to define a second slot 484 that extends along the first direction T between the mating ends 450*b* of the second at least one signal contact 444*b* of the first row 442*b* and the mating ends 450*b* of the second at least one signal contact 448*b* of the second row 446*b*.

The first and second slots 480 and 484 have a height $D_4$ along the transverse direction and are configured to receive the busbar 426. The mating ends 450*a* and 450*b* are flexible between an unmated position and a mated position whereby the height $D_4$ when in the mated position is greater than the height $D_4$ when in the unmated position. That is, the height $D_4$ of the first and second slots 480 and 484 can be less than the thicknesses of the busbar 426 such that when the first and second slots 480 and 484 receive the busbar 426, the height $D_4$ of the first and second slots 480 and 484 expand to accommodate the busbar 426. When the busbar 426 is received by the first and second slots 480 and 484, the mating ends 450*a* and 450*b* bias toward the unmated position thereby creating a frictional fit with the busbar 426.

As shown in FIG. 9B, the upper and lower ends 474 and 478 of the first connector housing 440 include longitudinally extending rows of ventilation windows 500 that extend transversely through the housing body 454. In particular, the upper and lower ends 474 and 478 each include a first row 504 of ventilation windows 500 that are laterally elongate, and extend transversely through the upper and lower ends 474 and 478 such that the windows 500 that extend through the upper end 474 are aligned with the windows 500 that extend through the lower end 478. The upper and lower ends 474 and 478 of the connector housing 440 can further include a second row 508 of windows 500 that are laterally offset from the first row 504 of windows 500.

With continued reference to FIGS. 8A-8B, 9A, and 9C, the first connector housing 440 can include first and second attachment members 512 that are configured to attach the busbar 426 to the first connector housing 440. That is, the housing body 454 can carry first and second attachment members 512 that are configured to lockingly attach the busbar 426 to the first electrical power connector 414. As shown, the first and second attachment members 512 can be spaced from each other along the third direction L and can extend from the end walls 482 and 486, respectively.

Figure 8B:
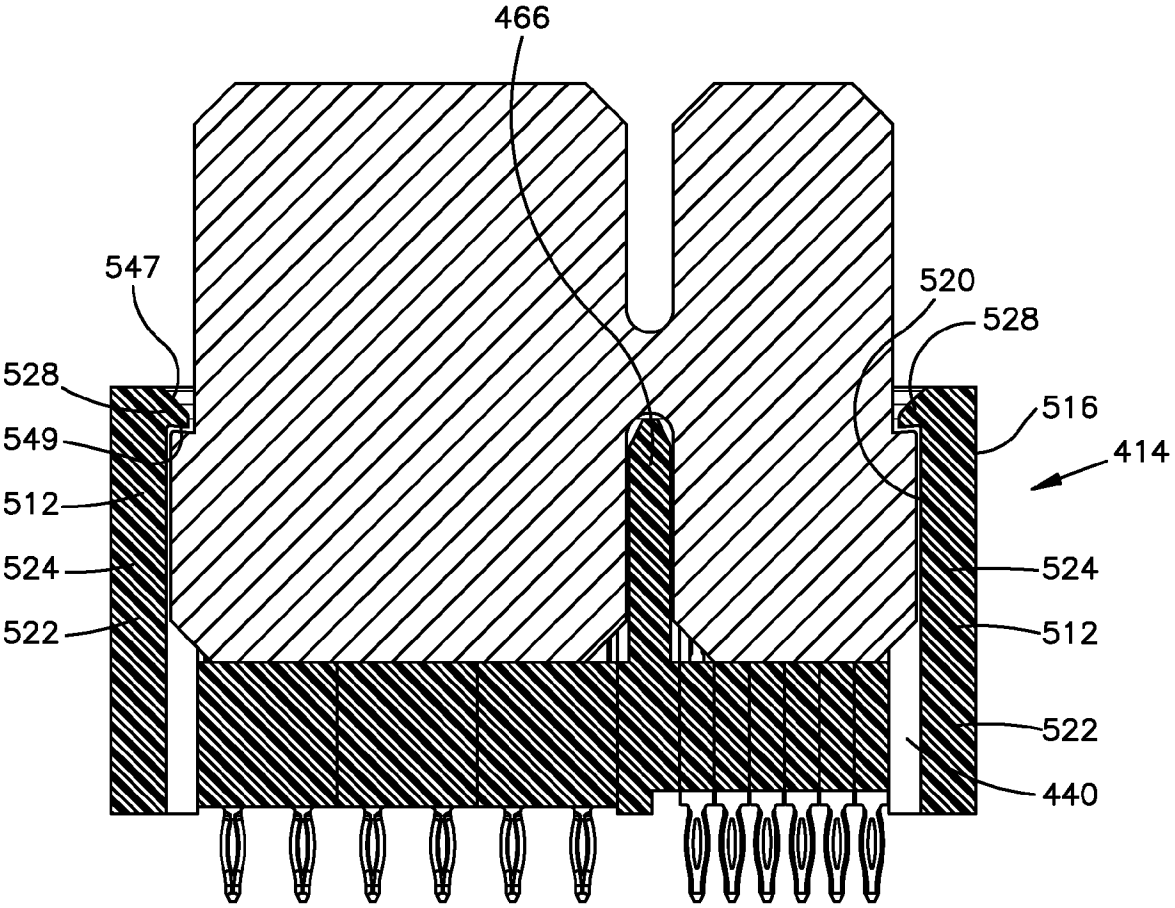
FIG. 8B is a cross-sectional view of the first busbar attached to the first power connector as shown in FIG. 8A through the line 8B-8B.
Figure 8A:
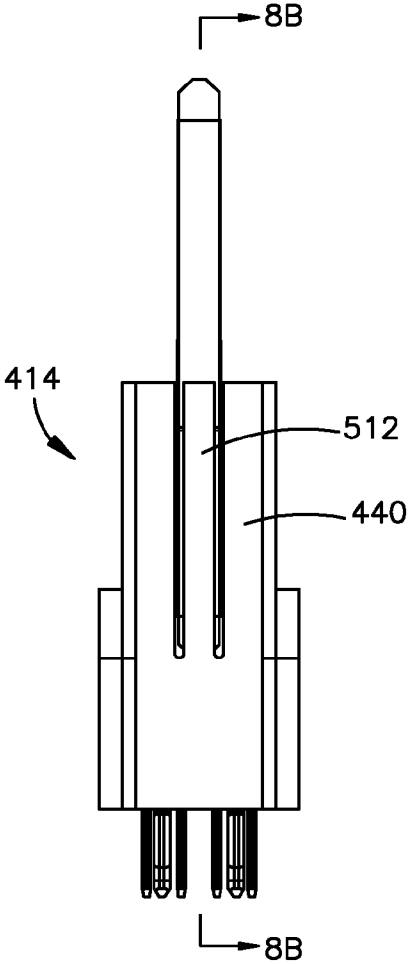
FIG. 8A is a side elevation view of the first busbar attached to the first power connector.

As shown in FIGS. 8A, 8B, and 9A, each end wall 482 and 486 of the first housing 440 defines an outer surface 516 and an inner surface 520 that is spaced from the outer surface 516 along the third direction L. The inner surfaces 520 at least partially define the first and second receptacles 458 and 462. As shown in FIGS. 8A and 8B, each of the first and second attachment members 512 is configured as a latch 522 that includes an arm 524 and a protrusion 528 that extends from the arm 524.

The arms 524 extend from a respective hinge 530 such that the arms 524 are configured to flex outwardly as the busbar 426 is being inserted into the slots 480 and 484. That is, each arm 524 can be resiliently flexible between an insertion position and a latched position such that as the busbar 426 is inserted into the first and second slots 480 and 484, the busbar 426 biases the latches 522 outward such that the protrusions 528 ride along respective outer surfaces of the busbar 426 until the busbar 426 is fully inserted into the slots 480 and 484, whereby the protrusions are aligned with corresponding attachment members of the busbar 426 and the arms 524 spring bias inward so as to attach the busbar 426 to the first electrical connector 414.

The protrusions 528 can extend from the arms 524 along the third direction L such that the protrusions 528 of the first and second attachment members 512 face each other along the third direction L. Each protrusion 528 can include an inner sloped surface 547 that slopes from respective outer surface and toward a longitudinal centerline of the first connector housing 440. Therefore, the inner sloped surfaces 547 of the first and second attachment members 512 slope toward each other as they extend inward. Each sloped surface 547 can terminate at an abutment surface 549 that faces the respective first and second receptacles 458 and 462. The sloped surfaces 547 are configured to ride against the respective outer surfaces of the busbar 426, and the abutment surfaces 549 are configured to abut respective abutment surfaces of the busbar 426 to thereby lockingly attach the busbar 426 to the first electrical connector 414. In this way it can be said that the first and second attachment members 512 are configured to mate with respective attachment members of the busbar 426 to thereby interfere with the busbar 426 so as to prevent the busbar 426 from moving along the second direction A with respect to the first housing 440.

With continued reference to FIG. 7, the second electrical connector 422 can also be configured as a receptacle connector. The second electrical connector 422 can be substantially identical as the first electrical power connector 414 and includes like structure and can operate in a similar manner. It should be appreciated, however, that while the second electrical connector 422 can be identical to the first electrical connector 414, the second electrical connector 422 can include structure that differs from the first electrical connector 414 so long as the second electrical connector 422 can receive the busbar 426.

Figure 10A:
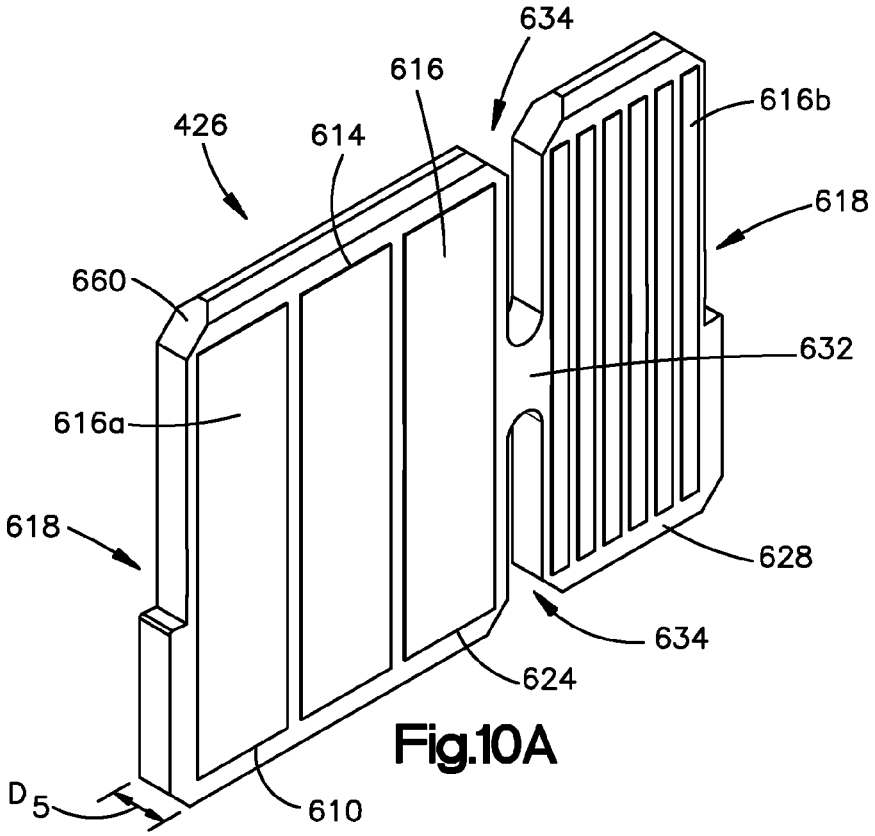
FIG. 10A is a perspective view of the first busbar shown in FIG. 7, the first busbar including a pair of attachment members.
Figure 10B:
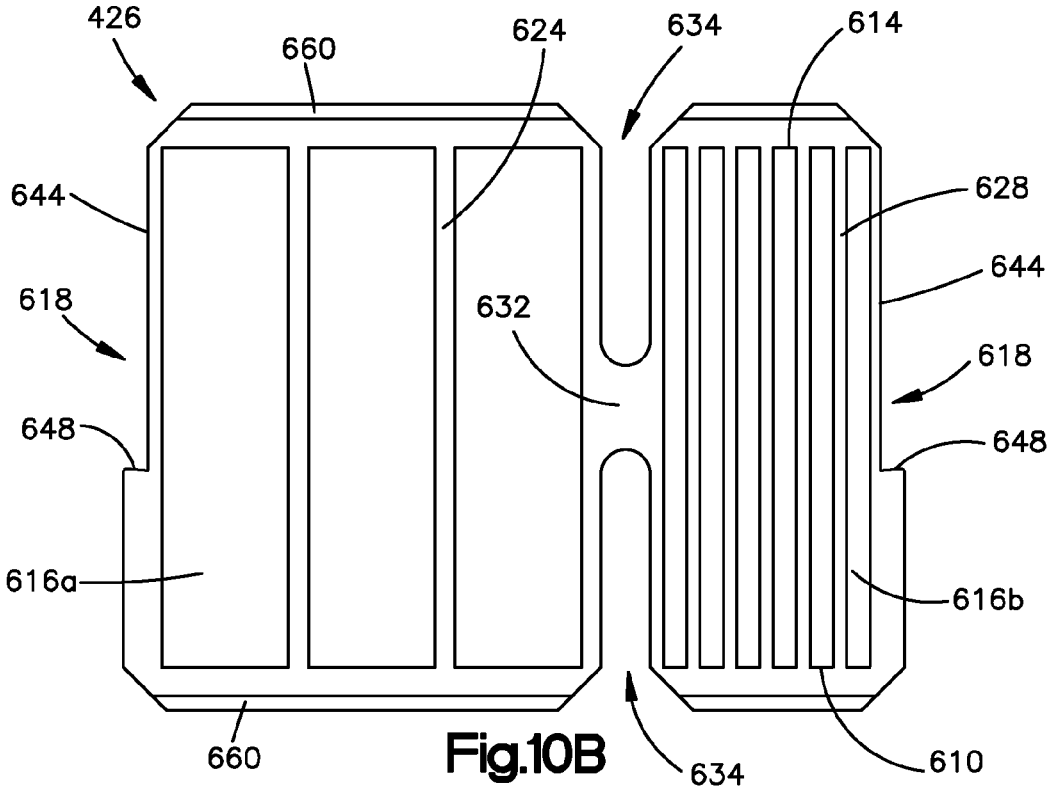
FIG. 10B is a top plan view of the busbar shown in FIG. 10A.

Now in reference to FIGS. 10A and 10B, the busbar 426 is electrically conductive and includes a busbar housing 615 and a plurality of electrically conductive busbar contacts 616 that are supported by the busbar housing 615. The busbar contacts 616 can each define a first end 610, a second end 614 opposite the first end 610. The busbar 426 can further define a pair of attachment members 618 that are each configured to mate with a respective attachment member 512 so as to attach the busbar 426 to the first connector housing 440. The first end 610 of the busbar contacts 616 are configured to be received by the first and second receptacles 458 and 462 of the first electrical connector 414 in a mating direction that is substantially parallel to the second direction such that the first end 610 of the busbar contacts 616 are brought into physical and electrical contact with the at least two mating ends 450*a* of each of the first and second rows 442*a* and 446*a* in the first slot 480 and the at least two mating ends 450*b* of each of the first and second rows 442*b* and 446*b* in the second slot 484. The second end 614 of the busbar contacts 616 are configured to be received by the first and second receptacles 458 and 462 of the second electrical connector 422 in a mating direction that is parallel to the second direction such that the second end 614 of the busbar contacts 616 are brought into physical and electrical contact with the at least two mating ends 450*a* of each of the first and second rows 442*a* and 446*a* in the first slot 480 and the at least two mating ends 450*b* of each of the first and second rows 442*b* and 446*b* in the second slot 484 of the second electrical connector 422.

The busbar housing 615 can defines first body portion 624, a second body portion 628, and a bridge portion 632 that connects the first body portion 624 to the second body portion 628 such that a pair of divider receiving channels 634 are defined between the first and second body portions 624 and 628. As shown in FIG. 8B, the first body portion 624 is configured to be received by the first receptacles 458 and the second body portion 628 is configured to be received by the second receptacles 462. As shown in FIG. 8B, the divider receiving channels 634 are configured to receive the dividers 466 when the busbar 426 is mated with the first and second electrical connectors 414 and 422. The channels 634 can thus be configured as alignment mechanisms. The busbar 426 can have a thickness $D_5$ measured along the first direction that is greater than the height of the slots when the mating ends are in the unmated position. In the illustrated embodiment the busbar 426 has a thickness that is between about 1.5 mm and about 2.0 mm. It should be appreciated, however, that the busbar 426 can have any thickness as desired.

The busbar housing 615 can further define beveled ends 660 that are adjacent the first and second ends of the busbar contacts. The beveled ends 660 can aid in the insertion of the busbar into the receptacles of the first and second electrical connectors 414 and 422.

As shown in FIGS. 10A and 10B, the first body portion 624 can support a plurality of power contacts 616*a* and the second body portion 628 can support a plurality of signal contacts 616*b*. Each power contact 616*a* can common the mating ends of respective power contacts of the first and second electrical connectors 414 and 422 and each signal contact 616*b* can electrically couple to the mating ends of respective signal contacts of the first and second electrical connectors 414 and 422. It should be appreciated, that the busbar contacts 616*a* and 616*b* can be monolithic or can include an intermediate conductive element between their respective first and second ends.

As shown in FIG. 10B, the busbar 426 can include a pair of attachment members 618 that are configured to mate with the attachment members 612 so as to attach the busbar 426 to the first connector housing 440. The attachment members 618 of the busbar 426 can be configured as recesses 644 that are defined by the busbar housing 615 and can be sized to receive the protrusions 528 so as to cause the attachment members 618 of the busbar 426 to mate with the attachment members 512. In particular, the recesses 644 can be at least partially defined by abutment surfaces 648 that are configured to abut the abutment surfaces 549 of the protrusions 528 to thereby lockingly attach the busbar 426 to the first electrical connector 414. As shown in FIG. 10B, the attachment members 640 can extend into the sides of the first and second body portions 624 and 628 as illustrated and can extend at least partially toward the second ends 614. Therefore when the busbar 426 is fully received by the first and second slots 480 and 484 of the first and second electrical connectors 414 and 422, the busbar 426 attaches to the first electrical connector 414, such that as the first electrical connector is moved away from the second electrical connector 422, the busbar 426 moves with the first electrical connector 414 such that the second ends of the busbar contacts withdraw from the first and second slots 480 and 484 of the second electrical connector 422.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An electrical connector assembly comprising:

an electrical connector including an electrically insulative connector housing that defines a receptacle, the electrical connector further including a first row of at least one power contact supported by the housing, and a second row of at least one power contact supported by the housing at a location spaced from the first row, each power contact of the first and second rows defining at least two mating ends that are at least partially disposed in the receptacle so as to define a slot that extends between the mating ends of the first row and the mating ends of the second row, the housing including a latch; and a busbar that includes an electrically conductive busbar contact having a first end and a second end opposite the first end, the busbar defining a recess that is configured to receive the latch so as to lockingly attach the busbar to the connector housing when the first end of the busbar contact is received by the receptacle in a mating direction such that 1) the first end of the busbar contact is brought into physical and electrical contact with the at least two mating ends of each of the first and second rows within the slot, and 2) the second end of the busbar contact is spaced from the receptacle in a withdrawal direction that is opposite the mating direction.

2. The electrical connector assembly of claim 1, wherein the connector housing includes a housing body that defines the receptacle and carries the latch.

3. The electrical connector assembly of claim 2, wherein the latch is resiliently flexible and includes an arm and a protrusion that extends from the arm.

4. The electrical connector assembly of claim 3, wherein the recess is sized to receive the protrusion.

5. The electrical connector assembly of claim 4, wherein the protrusion extends from the arm in a direction that is substantially perpendicular to the mating direction and the protrusion is received in the recess in the direction.

6. The electrical connector assembly of claim 5, wherein the arm is resiliently flexible between an insertion position and a latched position such that as the busbar is inserted into the slot, the busbar biases the resiliently flexible latch outward such that the protrusion rides along an outer side surface of the busbar until the busbar is fully inserted into the slot, whereby the protrusion is aligned with the recess and spring biases inward into the recess so as to lockingly attach the busbar to the electrical connector.

7. The electrical connector assembly of claim 1, wherein when the recess receives the resiliently flexible latch, the resiliently flexible latch interferes with the busbar so as to prevent the busbar from moving along the withdrawal direction with respect to the housing.

8. The electrical connector assembly of claim 1, wherein the latch is a first latch and the connector housing includes a second latch that is spaced from the first latch along a direction that is substantially perpendicular to the mating direction.

9. The electrical connector assembly of claim 8, wherein the first and second resiliently flexible latches are disposed at opposed ends of the receptacle and are configured to mate with respective recesses of the busbar so as to prevent the busbar from moving in the second direction with respect to the housing.

10. The electrical connector assembly of claim 2, wherein the receptacle is a first receptacle, and the housing body further defines a second receptacle, the housing body including a divider wall that is disposed between the first and second receptacles.

11. The electrical connector assembly of claim 10, wherein the connector housing further supports a second at least one power contact in each of the first and second rows, the second at least one power contact defining at least two mating ends that are at least partially disposed in the second receptacle so as to define a second slot that extends between the mating ends of the second at least one power contact of the first row and the mating ends of the second at least one power contact of the second row.

12. The electrical connector assembly of claim 11, wherein the busbar is a first busbar and the connector housing further includes a second latch that extends from the housing body, the electrical connector assembly further comprising a second busbar that includes an electrically conductive busbar contact having a first end and a second end opposite the first end, the second busbar defining a recess that is configured to receive the second latch so as to lockingly attach the second busbar to the connector housing when the first end of the second busbar contact is received in the second receptacle in the mating direction such that the first end of the second busbar contact is brought into physical and electrical contact with each of the at least two mating ends of each of the first and second rows in the second slot.

13. The electrical connector assembly of claim 10, wherein the electrical connector further includes a first row of signal contacts supported by the connector housing, and a second row of signal contacts supported by the connector housing at a location spaced from the first row of signal contacts, each signal contact of the first and second rows defining at least one mating end that is at least partially disposed in the second receptacle so as to define a second slot that extends between the mating ends of the first row of signal contacts and the mating ends of the second row of signal contacts, and wherein the first and second receptacles are configured to receive the busbar.

14. The electrical connector assembly of claim 13, wherein the busbar includes a first body portion, a second body portion, and a bridge portion that connects the first body portion to the second body portion such that a divider receiving channel is defined between the first and second body portions, the divider receiving channel being configured to receive the divider when the first body portion is received by the first receptacle and the second body portion is received by the second receptacle.

15. The electrical connector assembly of claim 14, wherein the connector housing includes a second latch, the first and second latches each including a flexible arm and a protrusion, the busbar further defining a pair of recesses that are configured to receive the protrusions to thereby locking attach the busbar to the electrical connector.

16. The electrical connector assembly of claim 1, wherein the busbar includes an electrically insulative busbar housing that supports the busbar contact.

17. The electrical connector assembly of claim 16, wherein the busbar includes a plurality of electrically conductive busbar contacts supported by the busbar housing.

18. The electrical connector assembly of claim 16, wherein the busbar includes a plurality of power contacts and a plurality of signal contacts.

19. An electrical connector assembly comprising:

a first electrical connector including an electrically insulative first connector housing that defines a first receptacle, the first electrical connector further including a first row of at least one power contact supported by the first connector housing, and a second row of at least one power contact supported by the first connector housing at a location spaced from the first row, each power contact of the first and second rows defining at least two mating ends that are at least partially disposed in the receptacle so as to define a slot that extends between the mating ends of the first row and the mating ends of the second row, the housing including a first attachment member;

a second electrical connector including an electrically insulative second connector housing that defines a second receptacle, the second electrical connector further including a first row of at least one power contact supported by the second connector housing, and a second row of at least one power contact supported by the second connector housing at a location spaced from the first row, each power contact of the first and second rows of the second electrical connector defining at least two mating ends that are at least partially disposed in the receptacle so as to define a slot that extends between the mating ends of the first row of the second electrical connector and the mating ends of the second row of the second electrical connector; and a busbar including an electrically conductive busbar contact that defines a first end and a second end that is spaced from the first end, the busbar including an attachment member that is configured to mate with the first attachment member to thereby lockingly attach the busbar to the first electrical connector when the busbar is fully received in the slot of the first electrical connector, wherein when the first end of the busbar contact is fully received in the slot of the first electrical connector and the second end of the busbar contact is fully received in the slot of the second electrical connector, the busbar lockingly attaches to the first electrical connector such that as the first and second electrical connectors are separated from each other, the busbar remains attached to the first electrical connector and the second end withdraws from the slot of the second electrical connector.

20. The electrical connector assembly of claim 19, wherein the first attachment member is configured as a latch that includes an arm and a protrusion that extends from the arm.

21. The electrical connector assembly of claim 20, wherein the attachment member of the busbar is configured as a recess, the recess being sized to receive the protrusion.

22. The electrical connector assembly of claim 21, wherein the connector housing carries a second attachment member that is spaced from the first attachment member.

23. The electrical connector assembly of claim 22, wherein (i) the first and second electrical connectors each define respective first and second receptacles, (ii) the busbar is a first busbar that is received by the first receptacles, and (iii) the system further comprises a second busbar that includes a respective attachment member such that when the second busbar is received by the second receptacle of the first electrical connector the attachment member of the second busbar mates with the second attachment member to thereby lockingly attach the second busbar to the first electrical connector.

24. The electrical connector assembly of claim 22, wherein the busbar includes an electrically insulative busbar housing and a plurality of busbar power contacts supported by the busbar housing and a plurality of busbar signal contacts supported by the busbar housing.

25. A method of electrically connecting a first receptacle electrical connector to a second receptacle electrical connector, the method comprising:

inserting a first end of a busbar into a slot defined between first and second rows of electrically conductive mating ends of a first electrical receptacle connector such that the busbar lockingly attaches to the first electrical receptacle connector;

inserting a second end of the busbar into a slot defined between first and second rows of electrically conductive mating ends of a second electrical receptacle connector; and separating the first and second electrical receptacle connectors from each other; such that during the separating step, the busbar remains attached to the first electrical receptacle connector and the second end withdraws from the second electrical connector.

26. The method of claim 25, wherein the first inserting step comprises causing a first latch of the first electrical receptacle connector to flex outwardly as the first end of the busbar is inserted into the slot of the first electrical receptacle connector.

* * * * *